US010736379B2

(12) United States Patent
Cook et al.

(10) Patent No.: US 10,736,379 B2
(45) Date of Patent: Aug. 11, 2020

(54) ARTICLE OF FOOTWEAR WITH INTERNAL FEEDBACK ELEMENTS

(71) Applicant: NIKE, Inc., Beaverton, OR (US)

(72) Inventors: Christopher S. Cook, Portland, OR (US); Shane S. Kohatsu, Portland, OR (US); Bret Schoolmeester, Banks, OR (US)

(73) Assignee: NIKE, Inc., Beaverton, OR (US)

( * ) Notice: Subject to any disclaimer, the term of this patent is extended or adjusted under 35 U.S.C. 154(b) by 132 days.

(21) Appl. No.: 15/983,522

(22) Filed: May 18, 2018

(65) Prior Publication Data

US 2018/0343966 A1 Dec. 6, 2018

Related U.S. Application Data

(60) Provisional application No. 62/514,150, filed on Jun. 2, 2017.

(51) Int. Cl.

| | |
|---|---|
| ***A43B 5/00*** | (2006.01) |
| ***A43B 7/14*** | (2006.01) |
| ***A43B 7/24*** | (2006.01) |
| ***A43B 13/14*** | (2006.01) |
| ***A43B 13/28*** | (2006.01) |
| ***A43B 23/02*** | (2006.01) |
| ***A43C 1/04*** | (2006.01) |
| *A43C 5/00* | (2006.01) |
| *A43C 1/00* | (2006.01) |

(52) U.S. Cl.

CPC ..... *A43B 7/1455* (2013.01); *A43B 5/00* (2013.01); *A43B 7/141* (2013.01); *A43B 7/142* (2013.01); *A43B 7/1495* (2013.01); *A43B 7/24* (2013.01); *A43B 13/14* (2013.01); *A43B 13/28* (2013.01); *A43B 23/0265* (2013.01); *A43C 1/04* (2013.01); *A43C 1/00* (2013.01); *A43C 5/00* (2013.01)

(58) Field of Classification Search

CPC ..... A43B 7/1455; A43B 7/141; A43B 5/00
USPC ..... 36/114
See application file for complete search history.

(56) References Cited

U.S. PATENT DOCUMENTS

| | | | | |
|---|---|---|---|---|
| 2,070,116 | A | 2/1937 | Cutillo | |
| 2,142,839 | A | 1/1939 | Flint | |
| 3,543,765 | A | 12/1970 | Atzner | |
| 3,586,003 | A | 6/1971 | Baker | |
| 4,670,998 | A | 6/1987 | Pasternak | |
| 4,860,464 | A | 8/1989 | Misevich et al. | |
| 4,917,105 | A | 4/1990 | Tiitola et al. | |
| 5,784,807 | A | 7/1998 | Pagel | |
| 5,896,683 | A | 4/1999 | Foxen et al. | |
| 6,148,544 | A * | 11/2000 | Keen | A43B 5/06 36/1.5 |
| 6,701,529 | B1 | 3/2004 | Rhoades et al. | |

(Continued)

FOREIGN PATENT DOCUMENTS

| | | | |
|---|---|---|---|
| CN | 203482951 | U | 3/2014 |
| DE | 441042 | C | 2/1927 |

(Continued)

*Primary Examiner* — Timothy K Trieu
(74) *Attorney, Agent, or Firm* — Quinn IP Law

(57) ABSTRACT

An article of footwear includes an upper and a sole structure coupled to the upper. The sole structure and the upper collectively define an interior cavity therebetween. The sole structure further includes a reinforcing element spanning from the sole structure to the upper within the interior cavity.

17 Claims, 11 Drawing Sheets

(56) References Cited

U.S. PATENT DOCUMENTS

| | | | | |
|---|---|---|---|---|
| 6,715,218 | B2 | 4/2004 | Johnson | |
| D558,964 | S | 1/2008 | Truelsen | |
| 7,472,496 | B2 | 1/2009 | Potter et al. | |
| 7,490,416 | B2 | 2/2009 | Townsend | |
| 8,079,159 | B1 | 12/2011 | Rosa | |
| 8,327,560 | B2 | 12/2012 | Berend | |
| 8,689,467 | B2 | 4/2014 | Miner | |
| 8,776,402 | B2 | 7/2014 | Cromer, Jr. | |
| 9,125,454 | B2 | 9/2015 | De Roode et al. | |
| 9,179,739 | B2 * | 11/2015 | Bell | A43C 11/002 |
| 9,259,049 | B2 | 2/2016 | Adami et al. | |
| 9,848,674 | B2 * | 12/2017 | Smith | A43C 11/004 |
| 2003/0066207 | A1 * | 4/2003 | Gaither | A43C 1/04 36/50.1 |
| 2003/0221336 | A1 | 12/2003 | Krstic | |
| 2004/0221371 | A1 | 11/2004 | Kato | |
| 2009/0090027 | A1 | 4/2009 | Baudouin | |
| 2010/0218397 | A1 | 9/2010 | Nishiwaki et al. | |
| 2011/0014996 | A1 | 1/2011 | Shepherd et al. | |
| 2011/0030245 | A1 | 2/2011 | Truelsen | |
| 2011/0071448 | A1 | 3/2011 | Margiotta | |
| 2011/0099842 | A1 | 5/2011 | Burke et al. | |
| 2011/0131841 | A1 | 6/2011 | Foster | |
| 2011/0258883 | A1 | 10/2011 | Eder et al. | |
| 2011/0277349 | A1 | 11/2011 | Kim | |
| 2012/0260527 | A1 | 10/2012 | Noh | |
| 2014/0325876 | A1 | 11/2014 | Dodge et al. | |
| 2015/0033588 | A1 | 2/2015 | Lai | |
| 2016/0066645 | A1 | 3/2016 | Tanmatsu et al. | |
| 2016/0095389 | A1 | 4/2016 | Minami et al. | |

FOREIGN PATENT DOCUMENTS

| | | | |
|---|---|---|---|
| WO | 2009106077 | A1 | 9/2009 |
| WO | 2014110264 | A1 | 7/2014 |

* cited by examiner

ARTICLE OF FOOTWEAR WITH INTERNAL FEEDBACK ELEMENTS

CROSS-REFERENCE TO RELATED APPLICATION

This application claims priority to, and the benefit of, U.S. Provisional Patent Application No. 62/514,150, filed on Jun. 2, 2017.

BACKGROUND

The present disclosure relates generally to articles of footwear, and in particular to articles of footwear with uppers.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
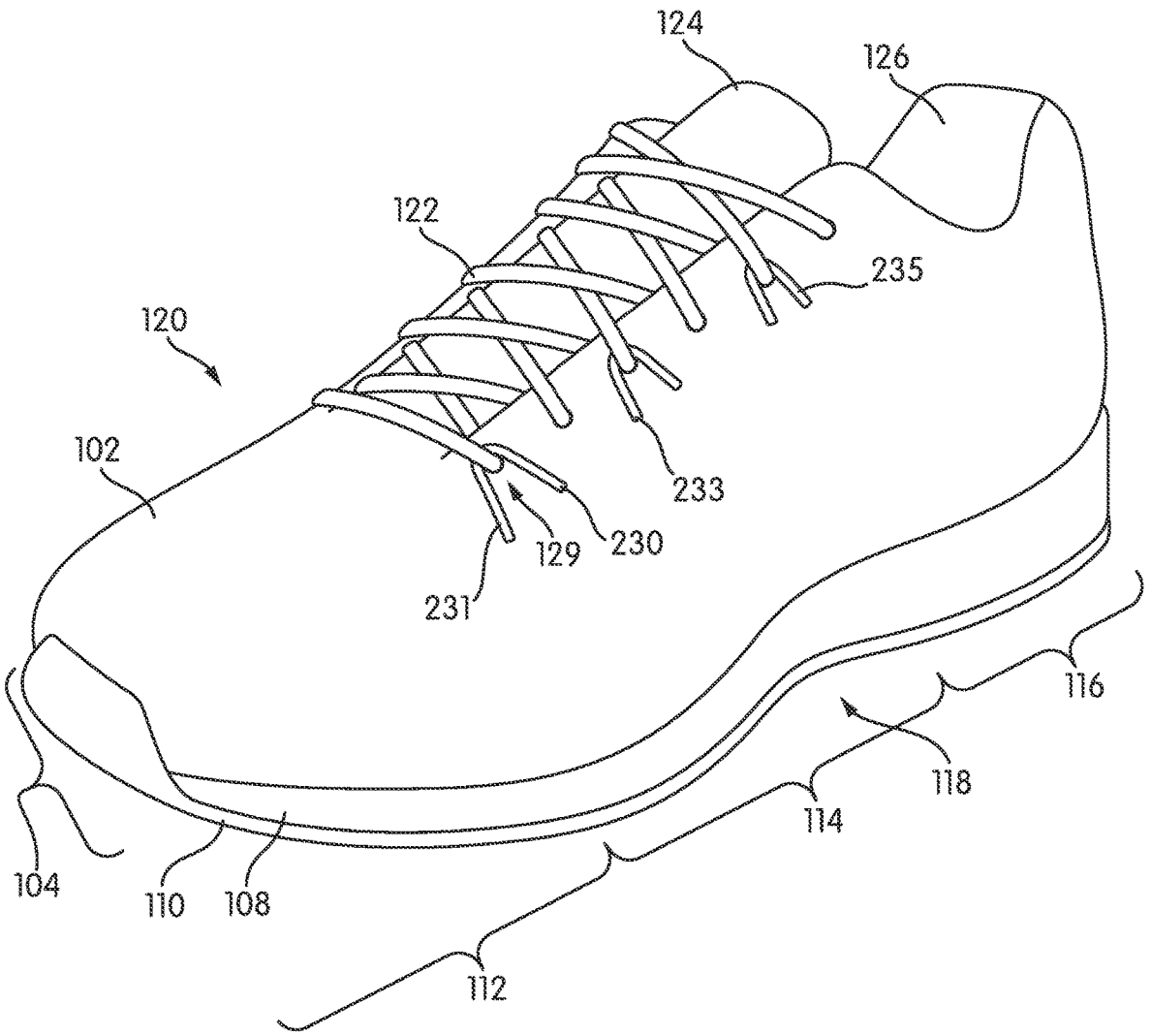
FIG. 1 is a medial isometric view of an embodiment of an article of footwear.

The present disclosure describes an article of footwear that includes an upper and a sole structure. The sole structure is coupled to the upper. The sole structure and the upper collectively define an interior cavity therebetween. The article of footwear further includes a reinforcing element extending from the sole structure to the upper within the interior cavity.

According to an aspect of the present disclosure, the reinforcing element may extend through the upper.

According to an aspect of the present disclosure, the reinforcing element is flexible to conform to a wearer's arch.

According to an aspect of the present disclosure, the reinforcing element may provide proprioceptive feedback.

According to an aspect of the present disclosure, the sole structure defines a peripheral edge along the medial side of the sole structure. The reinforcing element has a first end and a second end. The first end of the reinforcing element may be attached to the sole structure inward from the peripheral edge defined along the medial side of the sole structure. The second end of the reinforcing element may be attached to the fastening system adjacent the upper.

According to an aspect of the present disclosure, the article of footwear further includes a fastening system disposed on the upper. The reinforcing element includes an intermediate portion disposed between the first end and the second end. The intermediate portion of the reinforcing element may be attached to the fastening system. The second end of the reinforcing element may be attached to the sole structure.

According to an aspect of the present disclosure, tightening the reinforcing element tightens the reinforcing element between a medial side of the upper and a medial side of the sole structure.

According to an aspect of the present disclosure, the fastening system includes eyelets and a lace extending through the eyelets. The reinforcing element may be attached to at least one eyelet of the plurality of eyelets.

The present disclosure further describes an article of footwear including an upper and a sole structure coupled to the upper. The sole structure defines a midline and a peripheral edge. Further, the sole structure and the upper collectively define an interior cavity therebetween. The article of footwear further includes a first reinforcing element extending from the sole structure to the upper within the interior cavity. At least one end of the first reinforcing element is attached to the sole structure. The article of footwear further includes a second reinforcing element extending from the sole structure to the upper within the interior cavity. At least one end of the second reinforcing element is attached to the sole structure. The distance from the peripheral edge of the sole structure to at least one end of the first reinforcing element differs from the distance from the peripheral edge of the sole structure to at least one end of the second reinforcing element.

According to an aspect of the present disclosure, the article of footwear may further include a third reinforcing element extending from the upper to the sole structure. At least one end of the third reinforcing element may be attached to the sole structure.

According to an aspect of the present disclosure, the distance from the peripheral edge of the sole structure to at least one end of the first reinforcing element may differ from the distance from the peripheral edge of the sole structure to at least one end of the third reinforcing element. The distance from the peripheral edge of the sole structure to at least one end of the second reinforcing element may differ from the distance from the peripheral edge to at least one end of the third reinforcing element.

According to an aspect of the present disclosure, the distance from the midline of the sole structure to the at least one end of the first reinforcing element differs from a distance from the midline of the sole structure to at least one end of the second reinforcing element and the distance from the midline of the sole structure to at least one end of the third reinforcing element.

According to an aspect of the present disclosure, the distance from at least one end of the first reinforcing element to the at least one end of the second reinforcing element may differ from a distance from the at least one end of the second reinforcing element to at least one end of the third reinforcing element.

According to an aspect of the present disclosure, the first reinforcing element and the second reinforcing element are tensile strands.

According to an aspect of the present disclosure, the distance from the midline of the sole structure to at least one end of the first reinforcing element may differ from the distance from the midline of the sole structure to the at least one end of the second reinforcing element.

According to an aspect of the present disclosure, an article of footwear includes an upper including a fastening system. The article of footwear further includes a sole structure coupled to the upper. The sole structure has a side and defines a peripheral edge along the side. The sole structure and the upper collectively define an interior cavity therebetween. The article of footwear further includes a plurality of reinforcing elements extending from the sole structure to the upper. The plurality of reinforcing elements connects to the sole structure inward from the peripheral edge of the side of the sole structure. The reinforcing elements are flexible and therefore configured to conform to an arch of a foot inserted within the interior cavity. The reinforcing elements provide proprioceptive feedback.

According to an aspect of the present disclosure, the reinforcing elements may be tensile strands.

According to an aspect of the present disclosure, the reinforcing elements connect to the fastening system.

According to an aspect of the present disclosure, tightening the fastening system tightens the reinforcing elements.

According to an aspect of the present disclosure, the fastening system may include eyelets and a lace extending through the eyelets. At least one reinforcing element may be attached to at least one eyelet.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

The figures disclose various exemplary embodiments of an article of footwear, also referred to simply as article, with a proprioceptive feedback system. A proprioceptive feedback system may be incorporated into any style of footwear including, for example, athletic footwear. A proprioceptive feedback system may be configured to provide feedback to the foot of the user in any sport requiring dynamic movement. For clarity, the following detailed description discusses articles of athletic footwear in the form of shoes associated with various sports, including, but not limited to, baseball, basketball, football, running, soccer, tennis, and other sports and activities where movement may be aided by an article of footwear provided with a proprioceptive feedback system. However, it should be noted that in other embodiments any other type of footwear could be used including, but not limited to, hiking boots, sneakers, as well as other kinds of shoes. Articles of footwear used with a proprioceptive feedback system may also take the form of any non-athletic shoe, including, but not limited to, dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Additionally, while a single article of footwear is shown in the current embodiments, the same principles taught in this detailed description could be applied to a second, complementary article of footwear.

For purposes of general reference, an article of footwear may be divided into three regions: forefoot region 112, midfoot region 114, and heel region 116. Forefoot region 112 may be generally associated with the toes and joints connecting the metatarsals with the phalanges. Midfoot region 114 may be generally associated with the arch of a foot. Likewise, heel region 116 may be generally associated with the heel of a foot, including the calcaneus bone. In addition, an article of footwear may include medial side 118 and lateral side 120. In particular, medial side 118 and lateral side 120 may be located on either side of a longitudinal axis bisecting the article. Additionally, the longitudinal axis may be further referred to as the midline. Furthermore, both medial side 118 and lateral side 120 may extend through forefoot region 112, midfoot region 114, and heel region 116.

It will be understood that forefoot region 112, midfoot region 114, and heel region 116 are only intended for purposes of description and are not intended to demarcate precise regions of an article of footwear. For example, in some cases, one or more of the regions may overlap. Likewise, medial side 118 and lateral side 120 are intended to represent generally two sides, rather than precisely demarcating an article of footwear into two halves. In addition, forefoot region 112, midfoot region 114, and heel region 116, as well as medial side 118 and lateral side 120, may also be applied to individual components of an article of footwear, including a proprioceptive feedback system, a sole structure, an upper, and/or any other component associated with the article.

FIGS. 1 through 22 illustrate an exemplary embodiment of an article of footwear with a proprioceptive feedback system. FIG. 1 is an isometric view of an embodiment of the article of footwear. In some embodiments, the article may include a number of individual components. The article may include upper 102 and sole structure 104 defining an internal cavity between the upper and sole structure. Generally, upper 102 provides a covering for the foot that comfortably receives and securely positions the foot with respect to sole structure 104. Upper 102 may be made from any suitable material or pluralities of materials, including but not limited to, for example, nylon, natural leather, synthetic leather, natural rubber, or synthetic rubber. In some cases, upper 102 may be made of any suitable knitted, woven or non-woven material.

Figure 2:
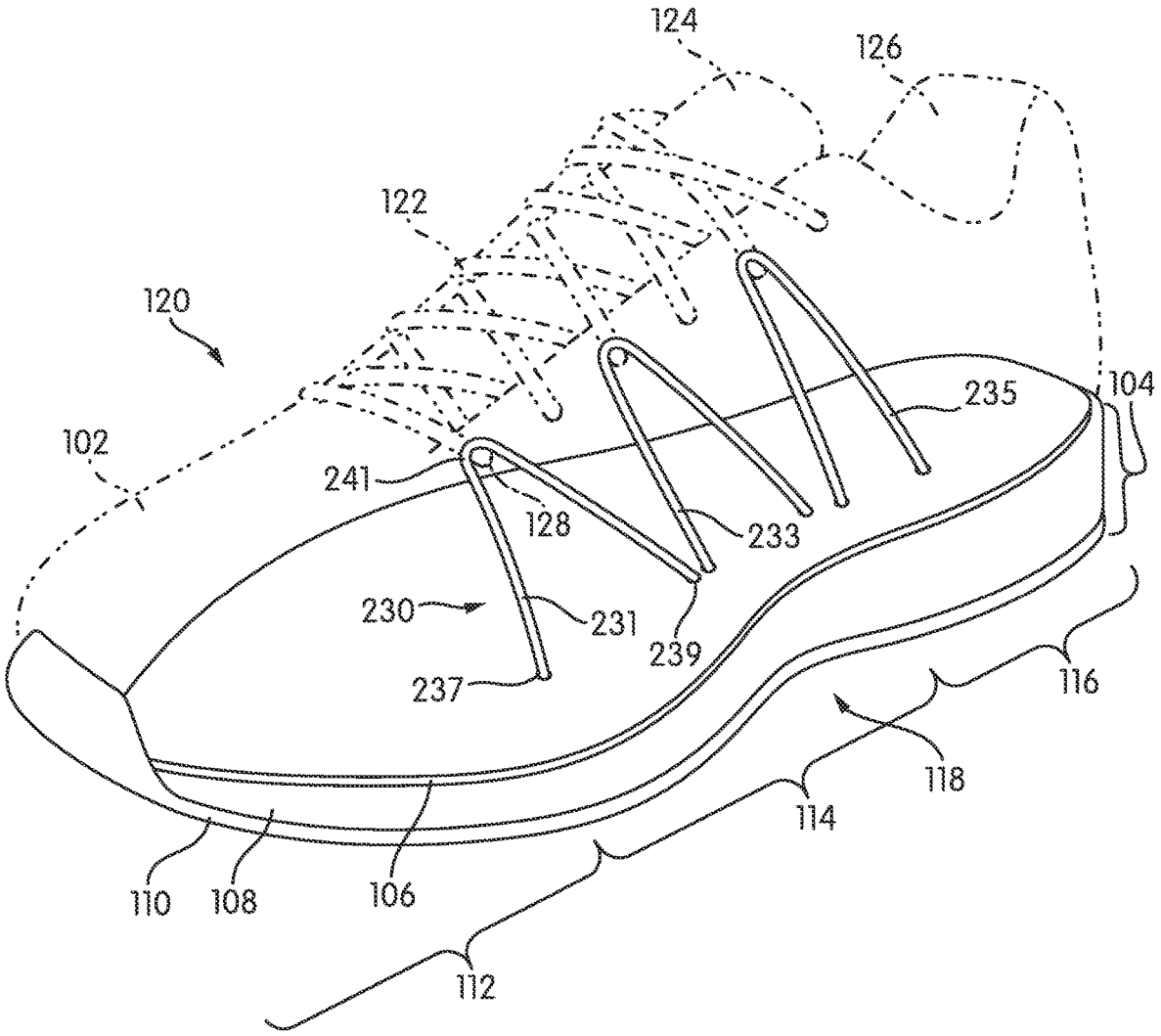
FIG. 2 is a medial isometric view of an embodiment of an article of footwear with an upper in phantom showing a plurality of reinforcing elements.

Generally, sole structure 104 is positioned between a foot of a wearer and the ground, and in different embodiments may incorporate various provisions. For example, as shown in FIGS. 1 and 2, sole structure 104 may include one or more of inner sole component or insole 106, outsole 110, and midsole 108. In other embodiments, sole structure 104 may comprise a unitary (single piece) sole, and/or any number of additional components. The insole may take the form of a sockliner adjacent the foot. It will be understood that in other embodiments, an insole may be optional. In addition, the outsole may be configured to contact a ground surface. The midsole may serve as a cushion and support for the foot. In other embodiments, the outsole, midsole and insole may be combined into a single structure.

The sole structure may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portion may include provisions for traction, including, but not limited to, traction elements, studs, and/or cleats. In some embodiments, such as illustrated in FIG. 1, outsole 110 is secured to a lower surface of midsole 108. It will be understood that in other embodiments, an outsole may be optional. For example, a midsole may be configured to contact a ground surface directly. Furthermore, in other embodiments, a midsole could be provided with various traction elements, studs, and/or cleats. In still other embodiments, portions of a midsole and portions of an outsole can both be configured to contact a ground surface.

The sole structure may be made of a variety of any suitable material or pluralities of materials for a variety of functions. In one embodiment, one or more components of a sole structure, such as a midsole component, may be formed from a polymer foam (e.g., a polyurethane or ethylvinylacetate foam) material that attenuates ground reaction forces (i.e., provides cushioning) during walking, running, and other ambulatory activities. In various embodiments, components of a sole structure may also include fluid-filled chambers, plates, moderators, or other elements that further attenuate forces, enhance stability, or influence the motions of the foot, for example. In some embodiments, such as illustrated in FIG. 1, outsole 110 is formed from a wear-resistant rubber material that is textured to impart traction.

In different embodiments, upper 102 may have a variety of different configurations. In general, upper 102 includes an opening 126 that provides entry for the foot into an interior cavity of upper 102 in heel region 116. In particular, upper 102 may have any design, shape, size and/or color. For example, in the exemplary embodiment the article is an athletic shoe and so therefore upper 102 may have a low-top configuration that is shaped to provide high mobility for an ankle. In other embodiments, however, the upper could be configured as a high-top upper for basketball or other activities. In some embodiments, upper 102 may also include tongue 124 that provides cushioning and support across the instep of the foot. The upper may include, in some embodiments, a heel counter. In some embodiments, the heel counter is disposed over the upper's outer surface, while in others the heel counter is disposed within the upper. The upper may also include other features in the art including heel tabs, loops, etc.

The upper may include a fastening provision on a fastening region of the upper. In FIG. 1, the fastening provision is a lacing system, or lace 122 applied at a fastening region of upper 102. Other embodiments of fastening provisions, include, but are not limited to, laces, cables, straps, buttons, zippers as well as any other fastening features. In FIG. 1, the fastening region comprises a plurality of eyelets 129 (e.g. eyelet 128, see FIG. 2) on upper 102. In other embodiments the fastening region may comprise one or more tabs, loops, hooks, D-rings, hollows, or any other fastening features.

An article of footwear can include a proprioceptive feedback system that may take on various forms. In some embodiments, the proprioceptive feedback system is internal to the footwear. In some embodiments, the proprioceptive feedback system is integrated into the footwear. In other embodiments, the proprioceptive feedback system is removable. In some embodiments, the proprioceptive feedback system connects to the upper. In other embodiments, the proprioceptive feedback system connects to the sole structure. In still other embodiments, the proprioceptive feedback system extends between the upper and the sole structure. In some of those embodiments, the proprioceptive feedback system extends between the upper and the sole structure via the void (also referred to as the interior cavity) between the upper and the sole structure. Further still, in some of those embodiments, the feedback system extends between the upper and sole structure away from the peripheral edge of the upper and sole structure.

FIG. 2 illustrates an isometric view of an exemplary embodiment of article of footwear including a proprioceptive feedback system. In the view illustrated by FIG. 2, the proprioceptive feedback system takes the form of a plurality of reinforcing elements 230 (see also FIG. 1) extending in the void between upper 102 and sole structure 104.

In general, the proprioceptive feedback system is comprised of at least one reinforcing element. In some embodiments, the proprioceptive feedback system takes the form of a plurality of reinforcing elements. For example, in some embodiments two, three, or more reinforcing elements could be used. In the exemplary embodiment as shown in FIGS. 1 and 2, the plurality of reinforcing elements 230 are comprised of three reinforcing elements, including first reinforcing element 231, second reinforcing element 233, and third reinforcing element 235. In other embodiments, a single reinforcing element may be used.

In different embodiments, the specific type of reinforcing element used could vary. In some embodiments, such as FIG. 2, the plurality of reinforcing elements 230 are tensile strands. While in other embodiments, the reinforcing elements may comprise straps, strips, cables, or a solid sheet.

The material appropriate for the reinforcing elements may vary. In some embodiments, the reinforcing elements comprise identical materials, while in others, the material may vary. In addition, in some embodiments, the reinforcing elements are comprised of a single material. While in other embodiments, a combination of suitable materials may be used. Suitable material for reinforcing elements include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel, for example.

The thickness of the reinforcing elements can vary. In some embodiments, the reinforcing elements may be of a uniform thickness. In other embodiments the thickness may vary. In some embodiments, the thickness may vary between individual elements. While in other embodiments, the thickness may vary along the length of each element. In still other embodiments, the thickness may vary between each element and along the length of each element.

Embodiments may include various provisions for attaching reinforcing elements between an upper and a sole structure. In some embodiments, the reinforcing elements extend from the sole structure to the upper. In some embodiments, one or more ends of the reinforcing elements could terminate at the upper. In other embodiments, one or more ends of the reinforcing elements could terminate at the sole structure. Moreover, in some embodiments, two ends of a single reinforcing element could terminate at the same location, or nearby locations, on the upper or sole structure. In the embodiment shown in FIG. 2, FIG. 3, and FIG. 4, first reinforcing element 231 extends from one first end 237 on sole structure 104 to upper 102, looping around lace 122 at intermediate portion 241 and terminates with second end 239 back at sole structure 104. Moreover, the ends of the reinforcing elements are attached at different locations along the sole structure. For example, a first end of the reinforcing element terminates at the upper, while a second end terminates at the sole structure. In some embodiments, the reinforcing elements may traverse multiple times from the sole structure to the upper before terminating at either the upper or the sole structure.

Figure 3:
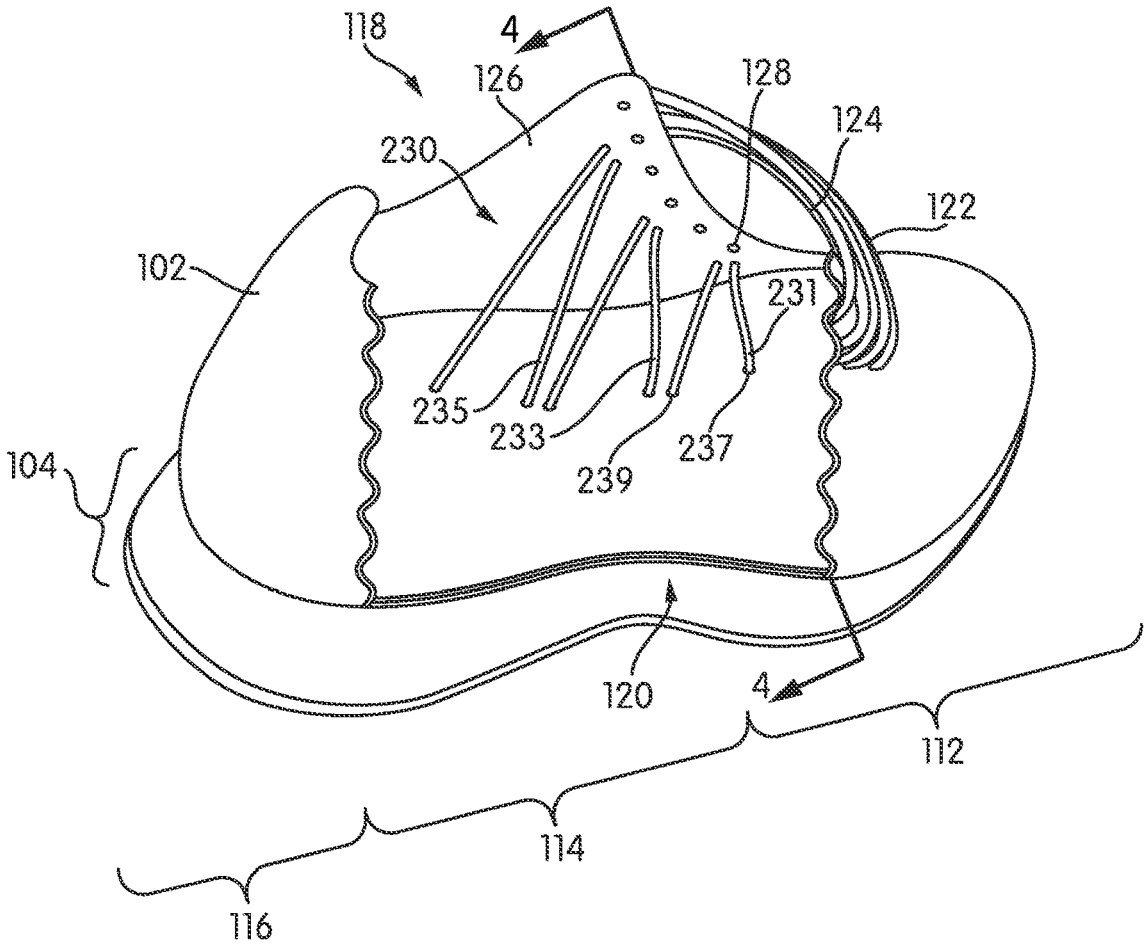
FIG. 3 is a perspective view of an embodiment of an article of footwear including a cutaway view.
Figure 4:
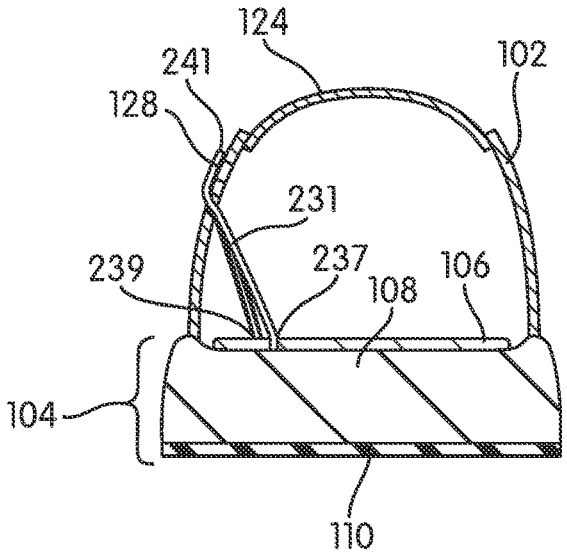
FIG. 4 is a cross-sectional view of the article of footwear shown in FIG. 3, taken along section line 4-4 of FIG. 3.

Different embodiments could utilize different provisions for attaching different portions of reinforcing elements to an upper. In FIG. 2, intermediate portions of plurality of reinforcing elements 230 contact upper 102 at eyelets on medial side 118 of upper 102. In the embodiment of FIG. 2, FIG. 3, and FIG. 4, first reinforcing element 231 may loop around lace 122. Specifically, intermediate portion 241 between first end 237 and second end 239 of first reinforcing element 231 may loop around lace 122, while both first end 237 and second end 239 terminate back at sole structure 104. Additionally, in FIG. 2, the plurality of reinforcing elements 230 is spaced apart from upper 102 and sole structure 104, with contact only at first end 237, second end 239 and intermediate portion 241 around lace 122. In other embodiments, the reinforcing elements may connect to a tab, loop, hook, D-ring, hollow, series of hollows, or any other fastening features. For example, in some embodiments, the terminal end of the reinforcing element may take the form of a knot looping around the lace.

Different embodiments could utilize differing locations for attaching portions of reinforcing elements to an upper. In FIGS. 3-7, intermediate portion 241 between first end 237 and second end 239 of first reinforcing element 231 may loop around lace 122 by exiting upper 102 via holes on upper 102 near eyelet 128 to loop around lace 122 outside of the footwear. In other embodiments, the reinforcing element may be entirely internal with respect to the upper. In still other embodiments, the holes on the upper may be replaced with slits, eyelets, among others.

Different embodiments may utilize different locations to attach the reinforcing elements to the sole structure. In some embodiments, the reinforcing elements contact the sole structure away from the peripheral edge of the sole structure. Also, in some embodiments, the contact locations are along the medial side of the sole structure. In still more embodiments, illustrated by FIG. 2, FIG. 3 and FIG. 4, the contact between plurality of reinforcing elements 230 and sole structure 104 occurs between ends of plurality of reinforcing elements 230 away from the peripheral edge of medial side 118 of sole structure 104. The peripheral edge refers to the inner edge of where the upper and sole structure intersect. In some embodiments, the first ends and the second ends of the reinforcing elements contact the sole structure within the midfoot region. In other embodiments, the reinforcing elements contact the sole structure in the forefoot region or the heel region. In additional embodiments, the reinforcing elements may primarily contact the sole structure within the midfoot region, while some contact locations may extend to the forefoot region or heel region. For example, as illustrated by FIG. 2, FIG. 3, and FIG. 4, the ends of plurality of reinforcing elements 230 contact sole structure 104 primarily within midfoot region 114, while some reinforcing elements may extend into forefoot region 112 and heel region 116.

Figure 5:
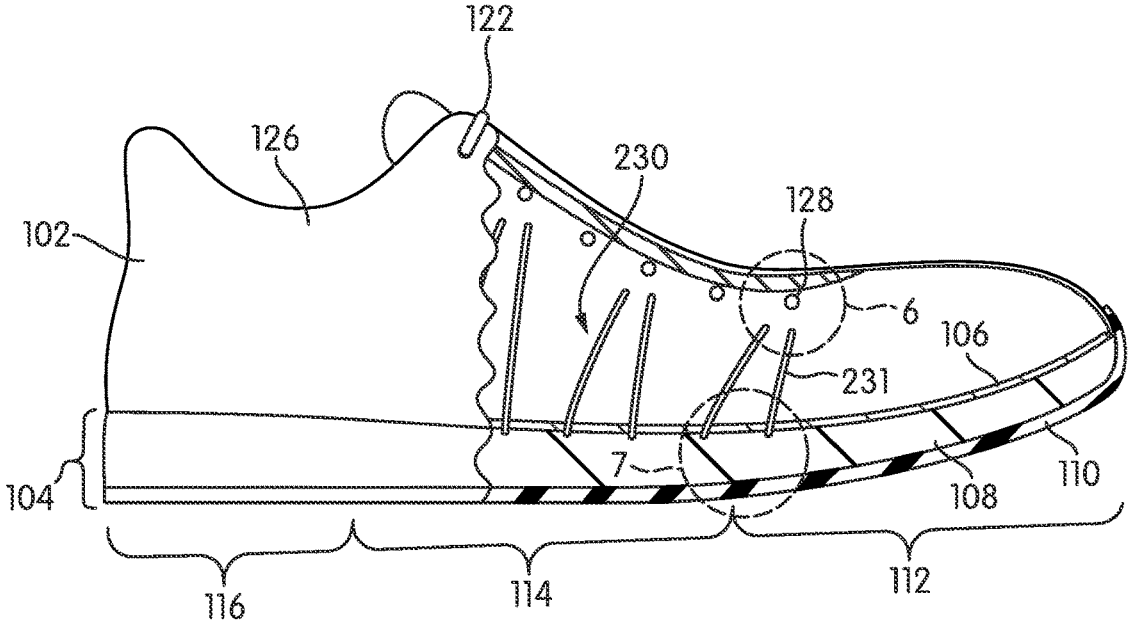
FIG. 5 is a partial cutaway view of an embodiment of an article of footwear including two enlarged views of an upper and sole structure.
Figure 6:
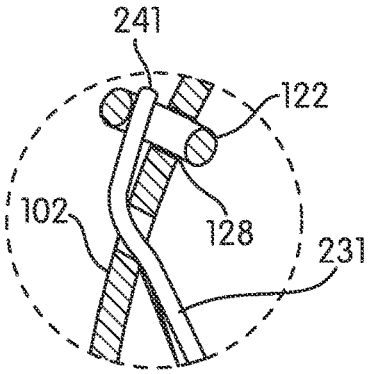
FIG. 6 is an enlarged, fragmentary, cross-sectional view of the article of footwear shown in FIG. 5, taken around area 6 of FIG. 5.
Figure 7:
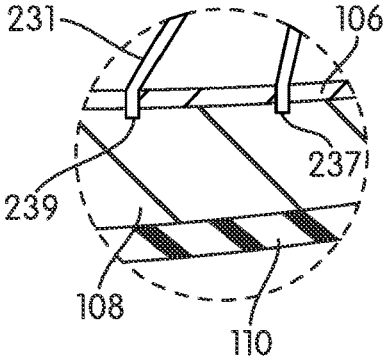
FIG. 7 is an enlarged, fragmentary, cross-sectional view of the article of footwear shown in FIG. 5, taken around area 7 of FIG. 7.

Differing embodiments could utilize differing provisions for attaching the reinforcing elements to the sole structure. In FIGS. 2-4, first end 237 and second end 239 of first reinforcing element 231 contact sole structure 104 at insole 106. In other embodiments, the reinforcing element connects to the sole structure at the midsole. In still other embodiments, such as illustrated by FIGS. 5-7, reinforcing element 231 has first end 237 connect to sole structure 104 at midsole 108 by connecting through insole 106. In yet other embodiments, the reinforcing elements connect to the sole structure at the midsole, connecting through the insole and penetrating into the midsole. In embodiments without an insole, reinforcing elements may connect to the sole structure at the surface of the midsole or penetrate into the midsole.

In various embodiments, different methods may be used to attach the reinforcing elements to the sole structure. In some embodiments, the reinforcing elements may attach to the sole structure using adhesive. In other embodiments, the reinforcing element may attach to the sole structure via heat, pressure, stitching, hook and loop fasteners, embedded anchors, and other methods of fixed and/or removable attachment.

Figure 8:
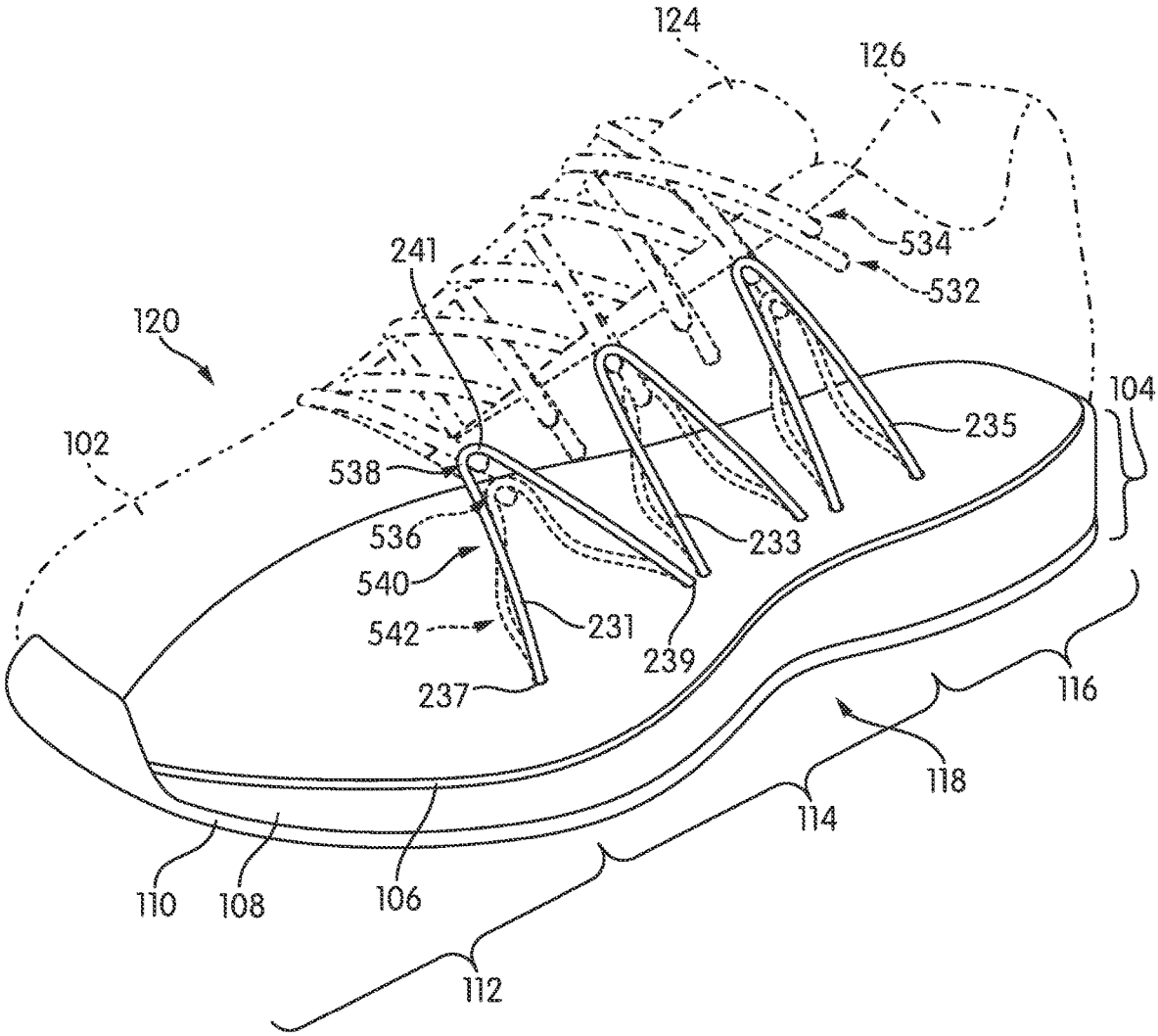
FIG. 8 is a medial isometric view of an embodiment of an article of footwear with the upper in phantom showing a plurality of reinforcing elements in both loose and taut configurations.

Embodiments may include provisions for connecting the reinforcing elements to the fastening system on the upper. In some embodiments, such as FIG. 8, the reinforcing system is linked to the tautness of the fastening system. FIG. 8 illustrates where a plurality of reinforcing elements are connected to a lace by looping an intermediate portion around lace 122 at adjacent eyelets, e.g. first reinforcing element 231 loops at intermediate portion 241 around eyelet 128. Furthermore, in some embodiments, tightening the fastening system tightens the reinforcing system. This is shown in FIG. 8, as when lace 122 is tightened into tight configuration 534, the plurality of reinforcing elements are tightened into taut reinforcing element configuration 540. In other embodiments, the tautness of the reinforcing system is independent of the tautness of the fastening system. In still other embodiments, the tautness of the reinforcing system is inversely proportional to the tautness of fastening system.

The reinforcing elements may differ in their initial state of tautness. In some embodiments, the reinforcing elements are initially taut. In other embodiments, such as in FIG. 8, the plurality of reinforcing elements 230 are shown in an initial loose configuration 542 corresponding with initial loose lacing configuration 532. As shown, eyelet 128 may be disposed at slightly different positions between tight lacing configuration 534 and initial loose lacing configuration 532. Initial loose lacing configuration 532 gives more slack than tight configuration 534, allowing a foot to more easily enter the footwear.

Differing embodiments demonstrate differing methods of tightening the reinforcing elements. In some embodiments, the reinforcing elements will tighten based on the motion of fastening regions. In some embodiments, the reinforcing elements will tighten based on the motion of the fasteners. In the illustrated embodiment of FIG. 8, eyelets will move based on the tautness of lace 122 of the fastening system. When lace 122 is tightened into tight configuration 534, the plurality of reinforcing elements 230 are tightened into taut reinforcing element configuration 540. During the tightening, medial side 118 and lateral side 120 of upper 102 are pulled together, moving medial side and lateral side eyelets from initial loose configuration 536 closer together in taut eyelet configuration 538.

At least in some embodiments, the reinforcing elements may avoid contact with the upper at places other than their attachment points when the reinforcing elements are taut. For example, in FIG. 8, when taut, intermediate portion 241 of first reinforcing element 231 will contact upper 102 in the region adjacent taut eyelet configuration 538, but may otherwise not be in contact with upper 102. Second reinforcing element 233 and third reinforcing element 235 may have a similar arrangement. In other configurations, the reinforcing elements may contact the upper in more locations than the fastening system when taut.

The reinforcing elements may avoid contact with the sole structure at places other than their attachment points when the reinforcing elements are taut. For example, in FIG. 8, first reinforcing element 231, when taut, will contact sole structure 104 only at first end 237 and second end 239, at locations inward from medial side 118 of sole structure 104. Other portions of reinforcing element 231, however, may not be in contact with the sole structure. Second reinforcing element 233 and third reinforcing element 235 may have a similar arrangement. In other configurations, the reinforcing elements may contact the sole structure in more locations than the fastening system when taut.

The reinforcing elements may avoid contact with both the upper and sole structure at places other than their attachment points when the reinforcing elements are taut. For example, in FIG. 8, first reinforcing element 231, when taut, will contact sole structure 104 on medial side 118 only at first end 237 and second end 239. Additionally, in FIG. 8, upper 102 will contact first reinforcing element 231 only with intermediate portion 241 on medial side 118. As such in FIG. 8, the plurality of reinforcing elements 230 are able to tension themselves along the medial side of the foot, not requiring the reinforcing elements to connect to the lateral side for tension. In other embodiments, the reinforcing elements, when taut, may contact the sole structure at places other than where the reinforcing elements are directly attached to the sole structure.

Figure 9:
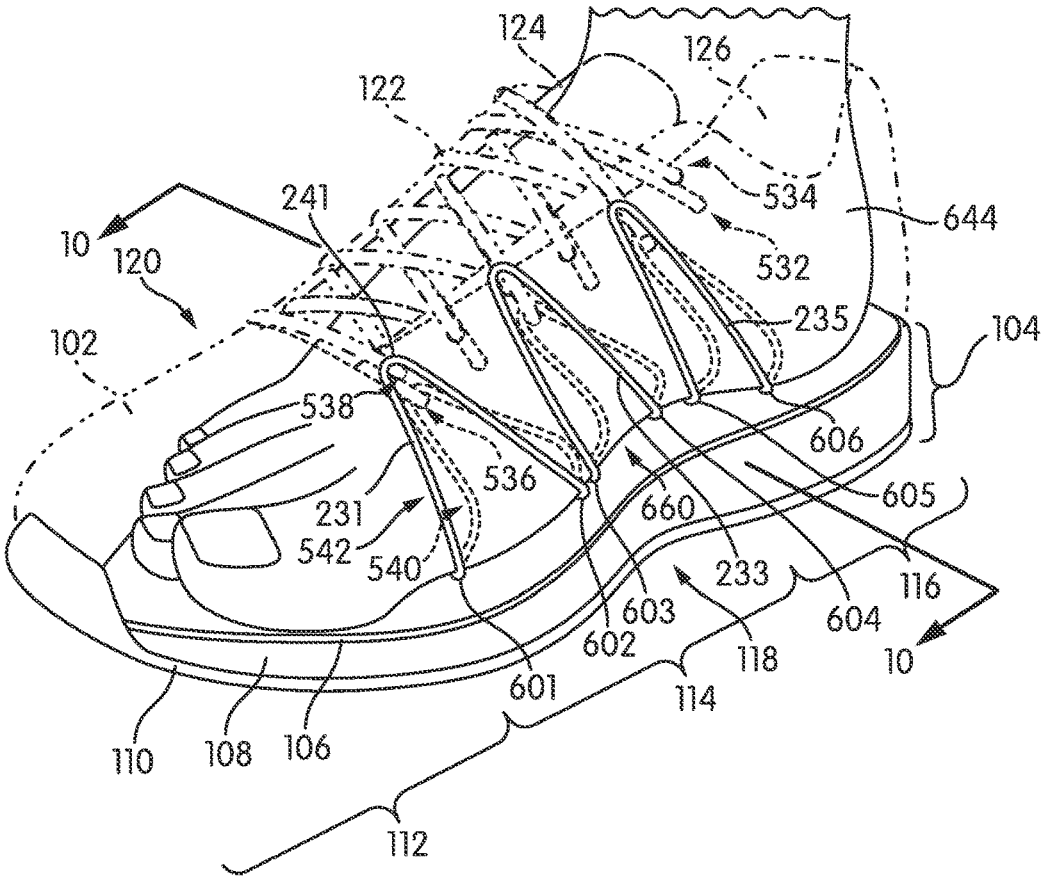
FIG. 9 is a medial isometric view of an embodiment of an article of footwear with a wearer's foot therein and showing an upper in phantom and a plurality of reinforcing elements in both loose and taut configurations.
Figure 10:
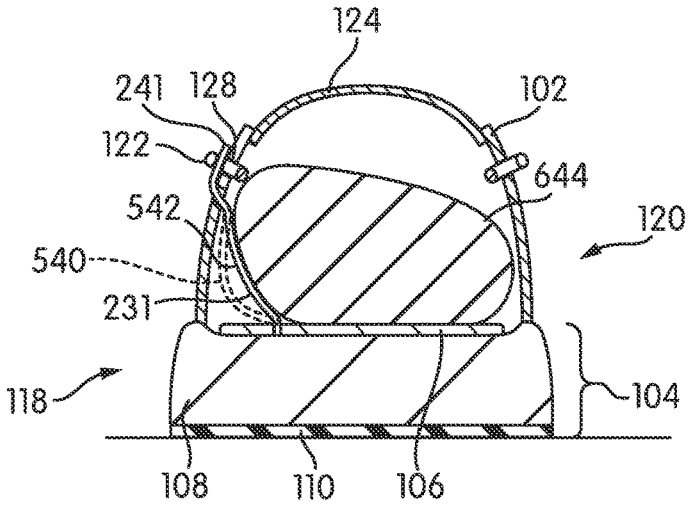
FIG. 10 is a cross-sectional view of the embodiment of the article of footwear shown in FIG. 9, taken along section line 10-10 of FIG. 9, showing at least one of the reinforcing elements in both loose and taut configurations.
Figure 11:
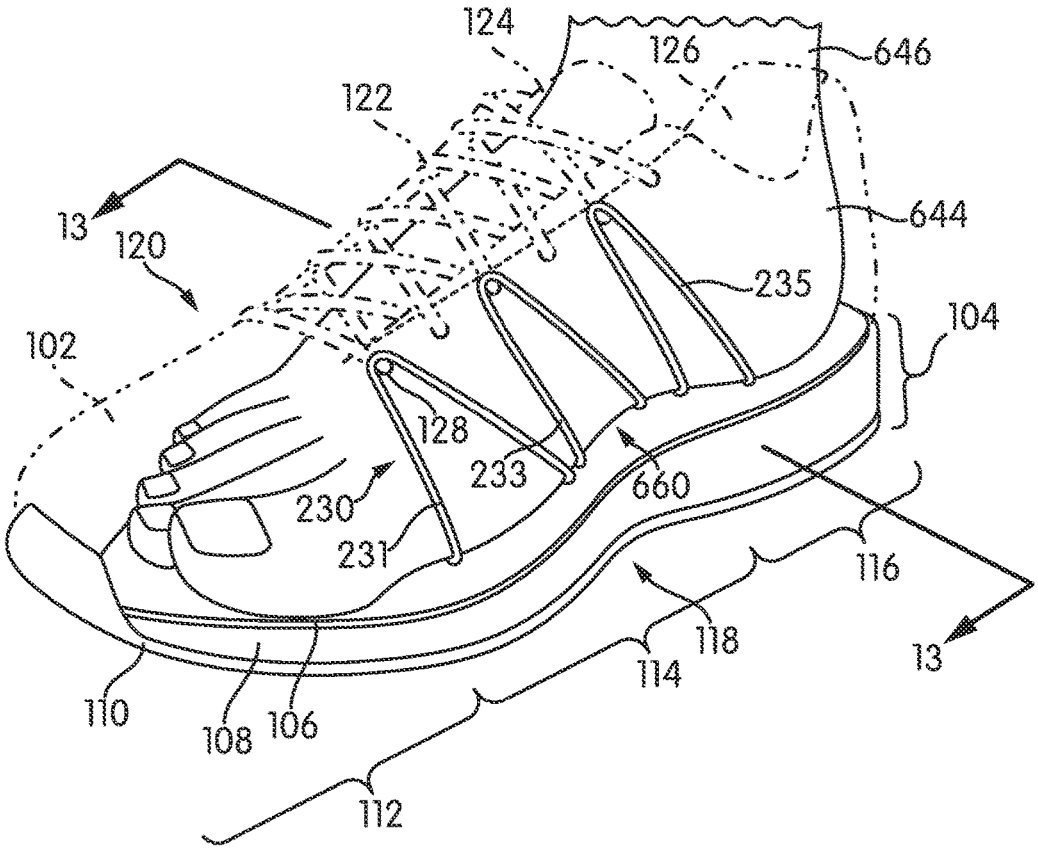
FIG. 11 is a medial isometric view of an embodiment of an article of footwear with a wearer's foot therein, wherein the wearer's foot is shown in a neutral position.
Figure 12:
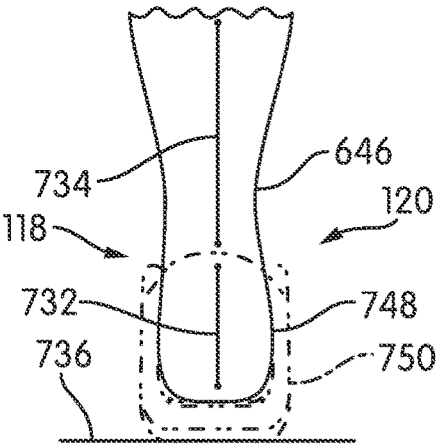
FIG. 12 is a rear view of the embodiment of the article of footwear shown in FIG. 11, showing an upper in phantom and a wearer's foot inside the article of footwear, wherein the wearer's foot is shown in a neutral position.
Figure 13:
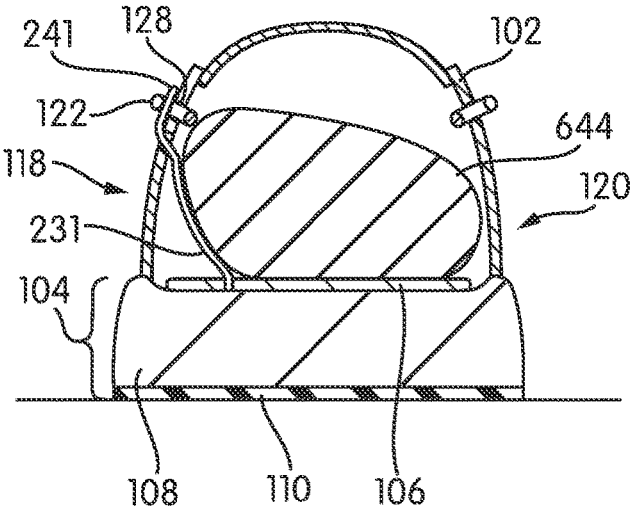
FIG. 13 is a cross-sectional view of the embodiment of the article of footwear shown in FIG. 11, taken along section line 13-13 of FIG. 11, wherein the wearer's foot is shown in a neutral position.

Embodiments may include provisions for fitting the reinforcing elements to the shape of a wearer's foot at different locations along the foot. In some embodiments, the reinforcing elements are arranged to fit the shape of a wearer's foot at the midfoot. In other embodiments, the reinforcing elements are arranged to fit the shape of a wearer's foot at the heel or forefoot. While in still other embodiments, the reinforcing elements are arranged to fit the shape of a wearer's foot at a combination of the forefoot, midfoot, or heel. For example, in FIGS. 9 and 10, the plurality of reinforcing elements 230 are predominately within midfoot region 114, with reinforcing element 231 having segment 602, reinforcing element 233 having segment 603, reinforcing element 233 having segment 604, and reinforcing element 235 having segment 605 following the shape of foot 644 within the midfoot region. FIGS. 9 and 10 also show reinforcing element 231 having segment 601 following the shape of foot 644 within forefoot region 112 and reinforcing element 235 having segment 606 following the shape of foot 644 within heel region 116.

Embodiments may include provisions for fitting the reinforcing elements to the shape of a wearer's foot at different locations on the footwear. In some embodiments, the reinforcing elements are arranged to fit the shape of the wearer's foot where the reinforcing elements connect to the sole structure. In other embodiments, the reinforcing elements are arranged to fit the shape of the wearer's foot where the reinforcing elements connect to the upper. In still other embodiments, the reinforcing elements are arranged to fit the shape of the wearer's foot in the void between the upper and sole structure. For example, in FIGS. 9 and 10, reinforcing elements are shaped to match the wearer's foot 644. Here first reinforcing element 231 has a first end, including reinforcing element segment 601, connected to sole structure 104. First reinforcing element 231 has a second end, including reinforcing element segment 602, connected to upper 102. Finally, first reinforcing element 231 has intermediate portion 241 exit upper 102 to wrap around lace 122 at eyelet 128. In other embodiments, the intermediate region may be in the void between the upper and the sole structure shaped to match the shape of the wearer's foot.

Embodiments may include provisions for fitting the reinforcing elements to the shape of a wearer's foot under differing tautness conditions. In some embodiments, the reinforcing elements may fit the shape of the wearer's foot only when tightened. In other embodiments, the reinforcing elements are flexible and fit the shape of the wearer's foot when loosened. For example, in FIGS. 9 and 10, the plurality of reinforcing elements 230 in tight configuration 542 conform to the shape of foot 644 along medial side 118 of wearer's arch 660. The plurality of reinforcing elements 230 in initial loose configuration 540 slacken to no longer match the shape of foot 644, making it easier to remove the footwear.

Embodiments may include provisions for the reinforcing elements providing support and/or feedback to the wearer's foot. In some embodiments, the reinforcing elements provide feedback to a wearer's foot. In other embodiments, the reinforcing elements provide support to the wearer's foot. In still other embodiments, the reinforcing elements provide both feedback and support to the wearer's foot. For example, in FIGS. 7-9, the plurality of reinforcing elements 230 provide support to foot 644 and ankle 646 as well as providing feedback to foot 644 during roll 856.

Figure 14:
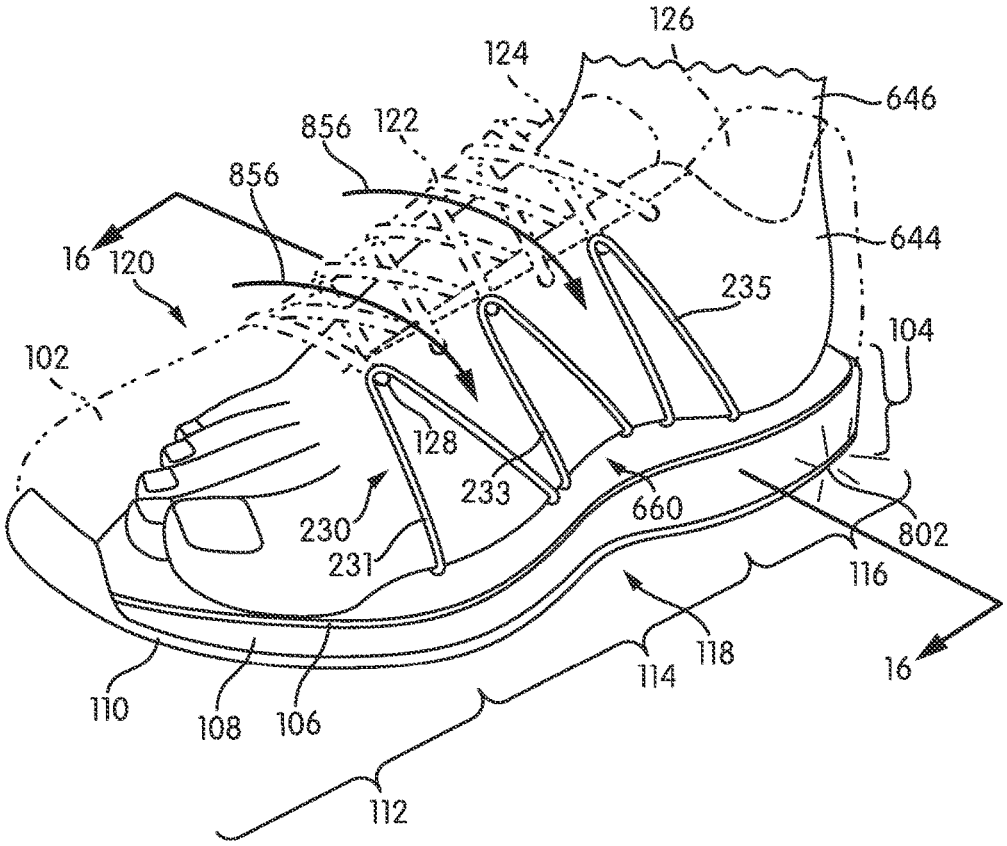
FIG. 14 is a medial isometric view of an embodiment of an article of footwear with a wearer's foot therein, wherein the wearer's foot is shown pronating normally at the end of the gait cycle.
Figure 15:
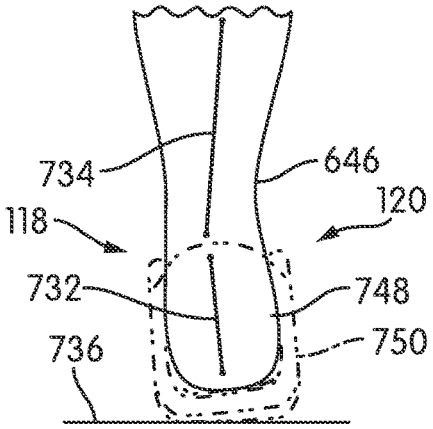
FIG. 15 is a rear view of the embodiment of the article of footwear shown in FIG. 14, showing an upper in phantom and a wearer's foot inside the article of footwear, wherein the wearer's foot is shown pronating normally at the end of the gait cycle.
Figure 16:
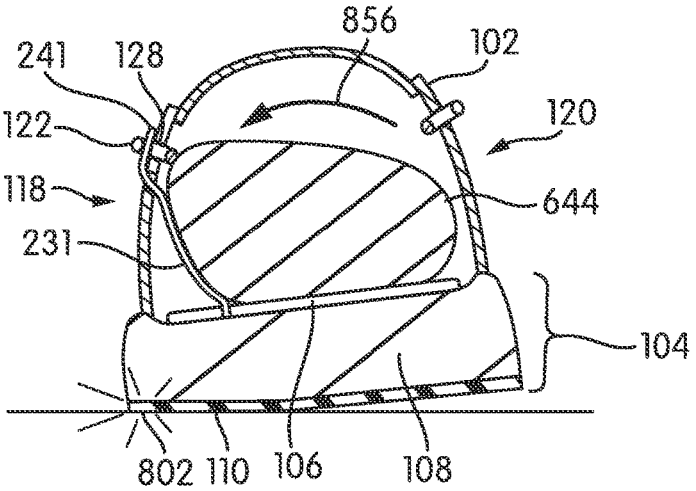
FIG. 16 is a cross-sectional view of the embodiment of the article of footwear shown in FIG. 14, taken along section line 16-16 of FIG. 14, wherein the wearer's foot is shown pronating normally at the end of the gait cycle.

Embodiments may include provisions for various types of feedback to a wearer's foot. In some embodiments, the feedback is tactile. This is shown in FIGS. 7-9 by the plurality of reinforcing elements 230 along wearer's foot 644, with the plurality of reinforcing elements 230 closely matching the shape of wearer's arch 660 in order to conform to wearer's arch 660. During roll 856, as illustrated in FIGS. 14-16, the plurality of reinforcing elements 230 become a contact surface within the footwear. The wearer will transfer his or her weight onto a plurality of reinforcing elements 230 during a roll, giving tactile feedback as the contact switches from placing the weight on sole structure 104 to plurality of reinforcing elements 230. In general, the reinforcing elements will have a smaller area compared to the sole structure and upper, resulting in tactile feedback when weight shifts from the sole structure or upper to the reinforcing elements. In others words, there is greater pressure on the wearer's foot 644 at the reinforcement elements 230 due to the reduced contact area and therefore greater tactile feedback.

Figure 17:
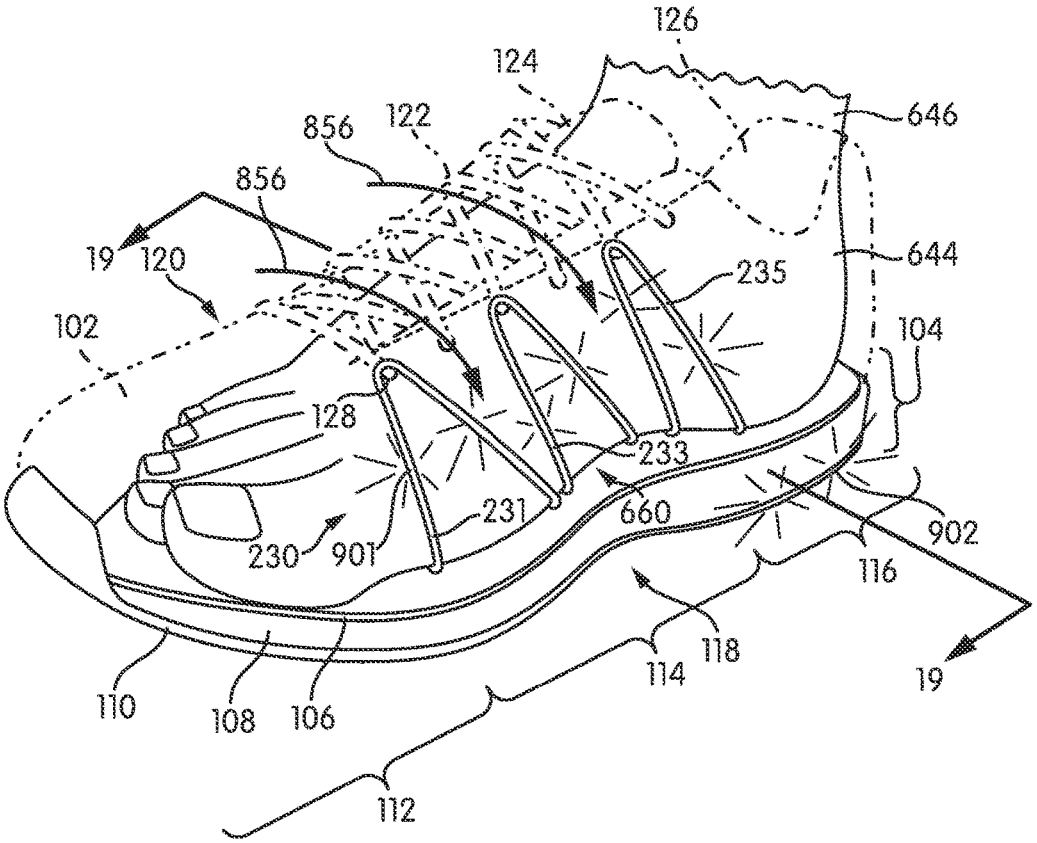
FIG. 17 is a medial isometric view of an embodiment of an article of footwear with a wearer's foot therein, wherein the wearer's foot is shown overpronating at the end of the gait cycle.
Figure 18:
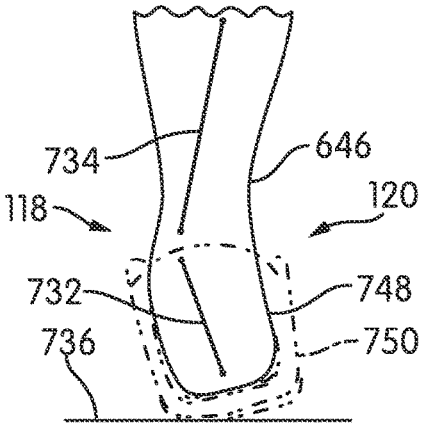
FIG. 18 is a rear view of the embodiment of the article of footwear shown in FIG. 17, showing an upper in phantom and a wearer's foot inside the article of footwear, wherein the wearer's foot is shown overpronating at the end of the gait cycle.
Figure 19:
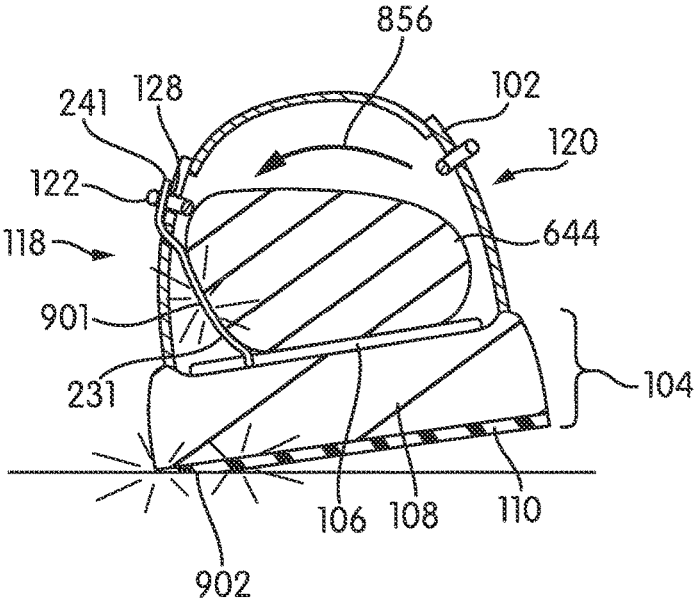
FIG. 19 is a cross-sectional view of the embodiment of the article of footwear shown along the midline of the foot from the front and the rear with the foot over pronating at the end of the gait cycle.

In some embodiments, providing tactile feedback to a wearer may affect the motion of the wearer. For example, tactile feedback could affect the wearer's gait cycle and/or the degree to which a wearer pronates. In a neutral position as in FIGS. 11-13, axis of ankle 734 and axis of foot 732 are in alignment and perpendicular to ground 736. Here, the feedback and support given by plurality of reinforcing elements 230 is negligible, as little weight to no weight is placed on the reinforcing elements 230, allowing back of the foot 748 and back of shoe 750 to spread weight evenly across ground 736. During a roll 856, as illustrated in FIGS. 14-16, axis of the foot 732 and axis of ankle 734 are no longer both perpendicular to ground 736. Here, the feedback and support given by the plurality of reinforcing elements 230 is increased, as weight is placed on reinforcing elements 230 due to the axes being no longer aligned, and back of the foot 748 and back of shoe 750 no longer spread weight evenly across ground 736. During an excessive roll, as illustrated in FIGS. 17-19, axis of foot 732 and axis of ankle 734 become even further out of alignment with ground 736. Here, the feedback and support given by the plurality of reinforcing elements 230 is increased again, as additional weight is placed on the plurality of reinforcing elements 230 due to axis of foot 732 being further out of alignment from axis of ankle 734.

In some cases, a wearer may alter his or her pronation in response to tactile feedback from one or more reinforcing elements. The feedback may discourage overpronation by minimizing the angle between the ankle and heel of the wearer's foot. Minimizing the angle of impact increases the relative surface area of the foot striking the ground during the gait cycle. In some cases, the wearer may be discouraged from over pronating as the reinforcing elements apply local forces to the medial side of the foot, which are distributed over relatively narrow contact areas (i.e., along the length of the reinforcing elements). For example, in FIGS. 14-19, the contact area between the footwear and ground 736 shrinks proportionally to how far the foot rolls during the gait cycle. In the normal pronation of FIG. 14-16, the foot rolls and contacts the reinforcing elements. The majority of the wearer's weight is distributed over a large contact area 802 with ground 736. Contact area 802 is inversely proportional to roll 856, the larger the roll, the smaller the contact area for the foot. Increasing the degree of roll to the overpronation, as shown in FIGS. 17-19, will significantly decrease the contact area to a much smaller contact area 902. Increasing the degree of roll to the overpronation, as shown in FIGS. 17-19, would normally cause the wearer's foot to press against upper 102 and along medial side 118 of sole structure 104. However, by including reinforcing elements, the weight of the wearer is shifted onto the reinforcing elements. In FIGS. 17-19, the wearer's foot impacts first reinforcing element 231 as represented by impact 901. Impact 901 may provide feedback to a wearer that encourages him or her to shift his or her weight so as to reduce the overpronation. Impact 901 is against a relatively small contact area of the reinforcing elements in comparison to the entire upper 102. In other embodiments, the feedback and support are configured to discourage any pronation.

Embodiments may include provisions for additional feedback and/or support to the foot when shaped to fit the wearer's foot. In some embodiments, the reinforcing elements fitting the shape of the wearer's foot may provide support and or feedback to the wearer's foot independent of the tautness of the reinforcing elements. In other embodiments, the reinforcing elements fitting the shape of the wearer's foot provide support and/or feedback to the wearer's foot only when the reinforcing elements are taut. For example, in FIGS. 17-19, the plurality of reinforcing elements 230 closely match the shape of wearer's arch 660 only when the plurality of reinforcing elements 230 are taut along the wearer's foot. As a result of closely matching the shape of the arch, the reinforcing elements remain against the arch during a roll, giving the wearer feedback.

In some embodiments, the tactile feedback is proprioceptive. For example, in FIGS. 17-19, by closely matching the plurality of reinforcing elements 230 to the shape of wearer's arch 660, the wearer will place his or her weight on the plurality of reinforcing elements 230 only during overpronation. Such feedback allows the user to feel whether the foot is properly placed, and gives awareness of the position of the foot. Since the wearer is aware of the position of his or her foot, the feedback is proprioceptive. Due to the position of the reinforcing elements 230, a wearer may feel the proper position of his or her foot during a roll and reduce overpronation but may not be provided with proprioceptive feedback by the reinforcing elements 230 during normal pronation.

In general, the reinforcing elements may connect to the sole structure in multiple locations, creating a pattern of connection points. In some embodiments, the reinforcing elements connect to the sole structure in a set pattern of connection points. In other embodiments, the pattern of connection points is adjustable. In some embodiments, the connection points are a set distance from the peripheral edge of the medial side. In other embodiments, the connection points are a set distance from the midline of the sole structure. In still other embodiments, the connection points vary in distance from both the midline and peripheral edge of the sole structure. In some embodiments, the connection points may increase their distance from the peripheral edge along the length of the footwear. In other embodiments, the connection points may decrease their distance from the peripheral edge along the length of the footwear. In still other embodiments, the distance of the connection points to the peripheral edge may decrease toward the midfoot. In yet another embodiment, the distance of the connection points to the peripheral edge may increase toward the midfoot. In some embodiments, the distance between the connection points is constant. While in other embodiments, the connection points may vary in distance from each other. In some embodiments, the connection points may vary in distance from each other with the spacing decreasing toward the midfoot, while in other embodiments the spacing between connection points may increase toward the midfoot.

Figure 20:
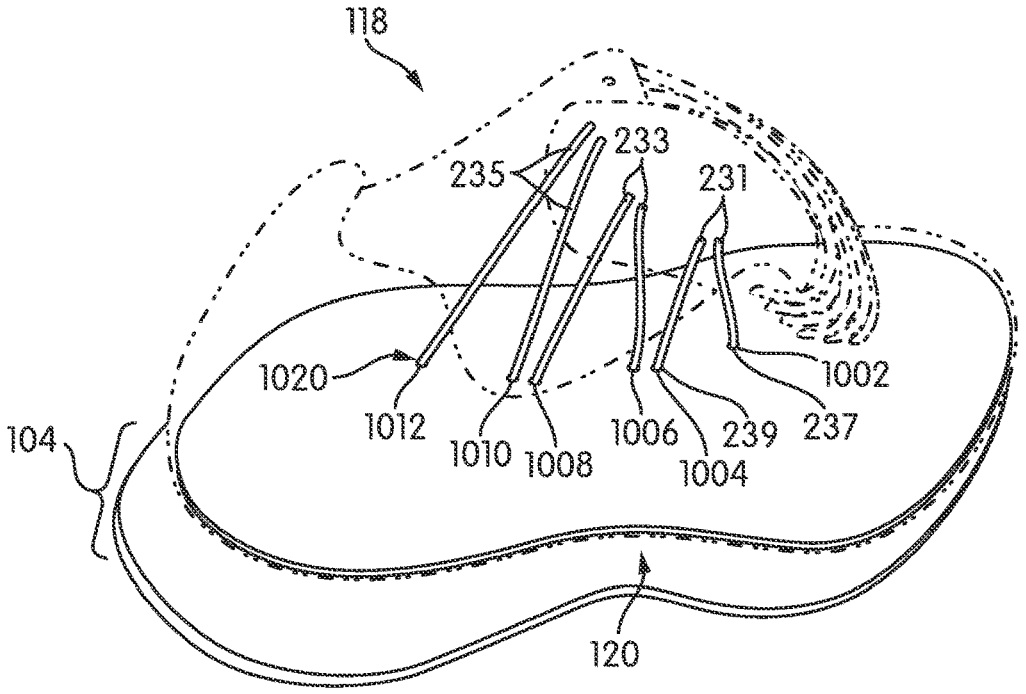
FIG. 20 is a medial isometric view of an embodiment of an article of footwear with an upper in phantom.
Figure 21:
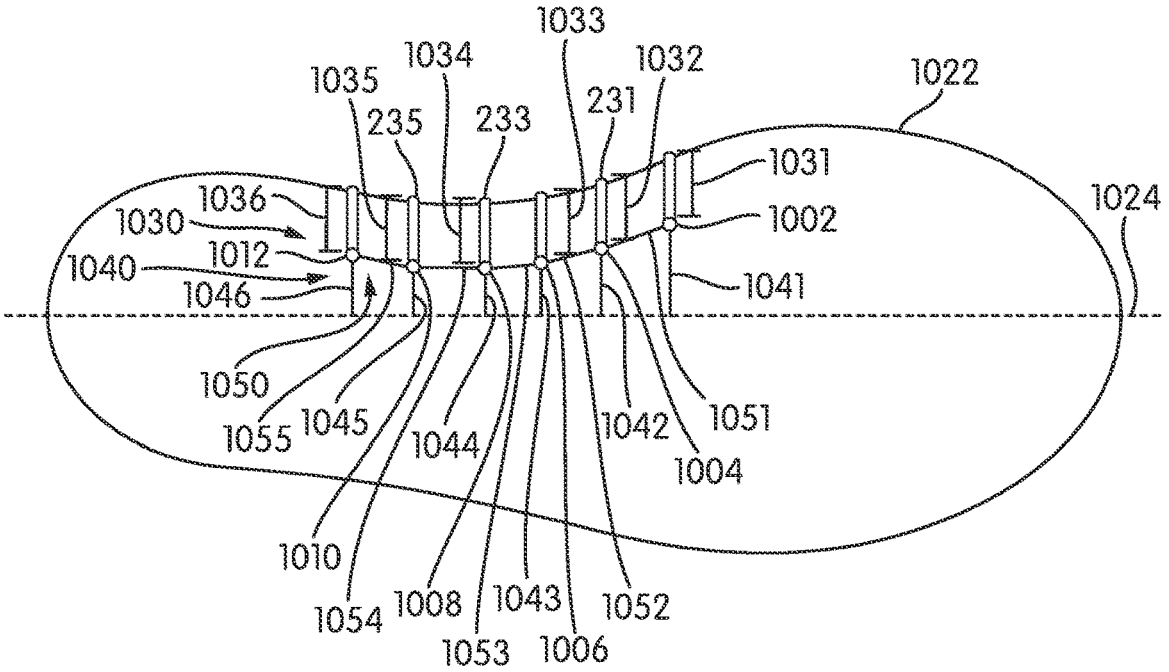
FIG. 21 is a cutout view showing a midsole schematic of the article of footwear shown in FIG. 20.

FIGS. 20 and 21 illustrate a medial isometric view of an exemplary embodiment of an article of footwear with a cutout view showing a schematic of sole structure 104. FIGS. 20 and 21 are intended to provide context and understanding for the various embodiments of FIGS. 22-25. In the cutout is a map of sole structure 104 with a set of connection points 1020 comprising first connection point 1002, second connection point 1004, third connection point 1006, fourth connection point 1008, fifth connection point 1010, and sixth connection point 1012. A plurality of reinforcing elements 230 connect to sole structure 104 at a set of connection points 1020. Here a first end 237 of first reinforcing element 231 connects with sole structure 104 at first connection point 1002 and a second end 239 of first reinforcing element 231 connects with sole structure 104 at second connection point 1004. Then, a first end of second reinforcing element 233 connects with sole structure 104 at third connection point 1006 and a second end of second reinforcing element 233 connects with sole structure 104 at fourth connection point 1008. Finally, a first end of third reinforcing element 235 connects with sole structure 104 at fifth connection point 1010 and a second end of third reinforcing element 235 connects with sole structure 104 at sixth connection point 1012.

The set of connection points 1020 is separated from the peripheral edge 1022 of medial side 118 by a set of distances 1030. The set of distances 1030 comprises first distance 1031, second distance 1032, third distance 1033, fourth distance 1034, fifth distance 1035, and sixth distance 1036. First distance 1031 corresponds to the distance between first connection point 1002 and peripheral edge 1022, second distance 1032 corresponds to the distance between second connection point 1004 and peripheral edge 1022, third distance 1033 corresponds to the distance between third connection point 1006 and peripheral edge 1022, fourth distance 1034 corresponds to the distance between fourth connection point 1008 and peripheral edge 1022, fifth distance 1035 corresponds to the distance between fifth connection point 1010 and peripheral edge 1022, and sixth distance 1036 corresponds to the distance between sixth connection point 1012 and the peripheral edge 1022.

The set of connection points 1020 is separated from the midline 1024 of the sole structure 104 by a set of distances 1040. The set of distances 1040 comprises seventh distance 1041, eighth distance 1042, ninth distance 1043, tenth distance 1044, eleventh distance 1045, and twelfth distance 1046. Seventh distance 1041 corresponds to the distance between first connection point 1002 and midline 1024. Eighth distance 1042 corresponds to the distance between second connection point 1004 and midline 1024. Ninth distance 1043 corresponds to the distance between third connection point 1006 and midline 1024. Tenth distance 1044 corresponds to the distance between fourth connection point 1008 and midline 1024. Eleventh distance 1045 corresponds to the distance between fifth connection point 1010 and midline 1024. Twelfth distance 1046 corresponds to the distance between sixth connection point 1012 and midline 1024.

The connections points included in the set of connection points 1020 are separated from each other by a set of distances 1050. The set of distances 1050 comprises thirteenth distance 1051, fourteenth distance 1052, fifteenth distance 1053, sixteenth distance 1054, and seventeenth distance 1055. Thirteenth distance 1051 corresponds to the distance between first connection point 1002 and second connection point 1004. Fourteenth distance 1052 corresponds to the distance between second connection point 1004 and third connection point 1006. Fifteenth distance 1053 corresponds to the distance between third connection point 1006 and fourth connection point 1008. Sixteenth distance 1054 corresponds to the distance between fourth connection point 1008 and fifth connection point 1010, and seventeenth distance 1055 corresponds to the distance between fifth connection point 1010 and sixth connection point 1012.

In general, the connection point pattern may correspond to the shape of the wearer's foot. In some embodiments, the connection point pattern may follow the shape of the sole to fit a normal shaped arch. In other embodiments, the connection point pattern may be a constant distance from the midline to better fit a flat foot. In another embodiment, the connection points may increase their distance from the peripheral edge toward the midfoot to better fit a high arch. In yet another embodiment, the connection points may increase the distance from the midline toward the midfoot to better fit a collapsed arch.

Figure 22:
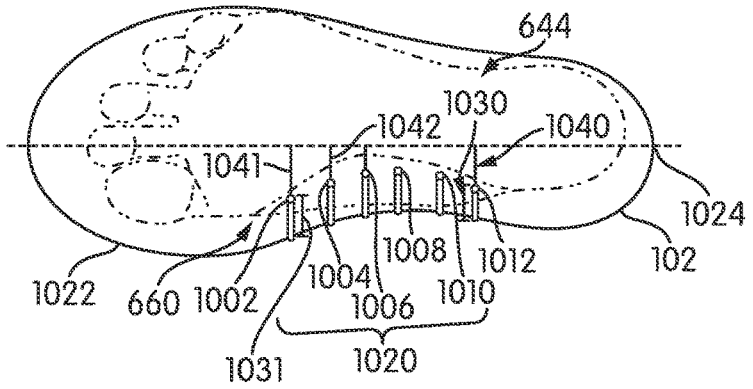
FIG. 22 shows a bottom view of a midsole schematic suitable for a normal arch.

FIGS. 22-25 illustrate various exemplary embodiments of midsole schematics. FIG. 22 illustrates the embodiment of FIGS. 20 and 21 where the respective distance between each of first connection point 1002, second connection point 1004, third connection point 1006, fourth connection point 1008, fifth connection point 1010, and sixth connection point 1012, and peripheral edge 1022 is constant. In FIG. 22 this is illustrated by the distances of the set of distances 1030 from peripheral edge 1022 being equal to first distance 1031. Also illustrated here, the seventh distance 1041 is greater than the eighth distance 1042 as set of distances 1040 from midline 1024 decreases toward the midfoot. Such a pattern may better fit a foot with a normal arch.

Figure 23:
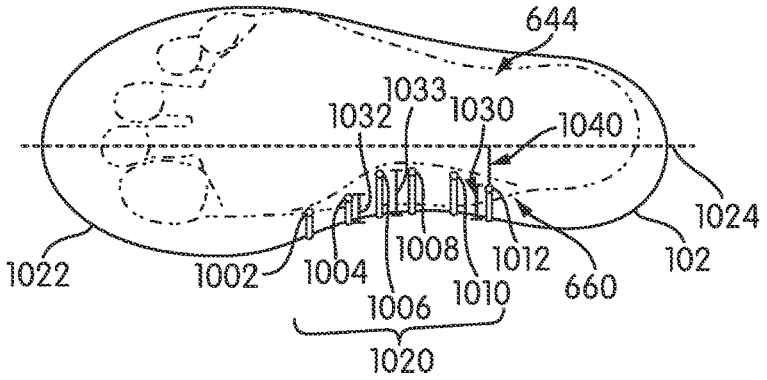
FIG. 23 shows a bottom view of a midsole schematic suitable for a high arch.

In FIG. 23, the respective distance between each of first connection point 1002, second connection point 1004, third connection point 1006, fourth connection point 1008, fifth connection point 1010, and sixth connection point 1012, and peripheral edge 1022 increases toward the midfoot. In FIG. 23, this is illustrated by third distance 1033 being longer than second distance 1032, as the distance of the set of distances 1030 from peripheral edge 1022 increase toward the midfoot, and thus the distances of the set of distances 1040 from midline 1024 decreases toward the midfoot. Such a pattern may better fit a foot with an unusually high arch.

Figure 24:
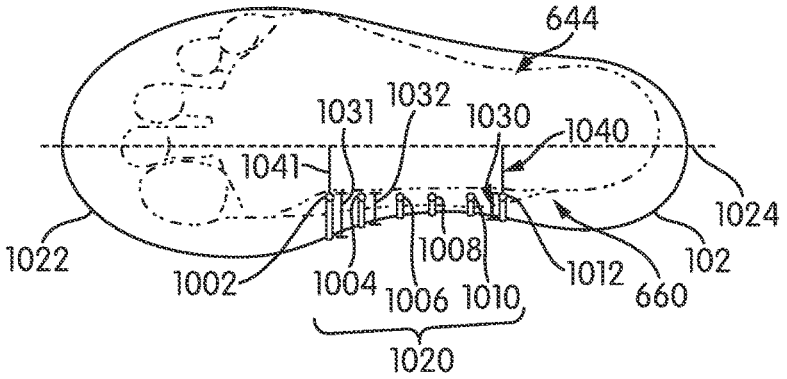
FIG. 24 shows a bottom view of a midsole schematic suitable for a flat arch.

In FIG. 24, the respective distance between each of first connection point 1002, second connection point 1004, third connection point 1006, fourth connection point 1008, fifth connection point 1010, and sixth connection point 1012, and midline 1024 is constant. In FIG. 24, this is illustrated by first distance 1031 being longer than second distance 1032, as set of distances 1030 from peripheral edge 1022 decreases toward the midfoot, while each distance of the set of distances 1040 from midline 1024 is constant with all distances being equal to the seventh distance 1041. Such a pattern may better fit a flat foot, where there is little to no arch.

Figure 25:
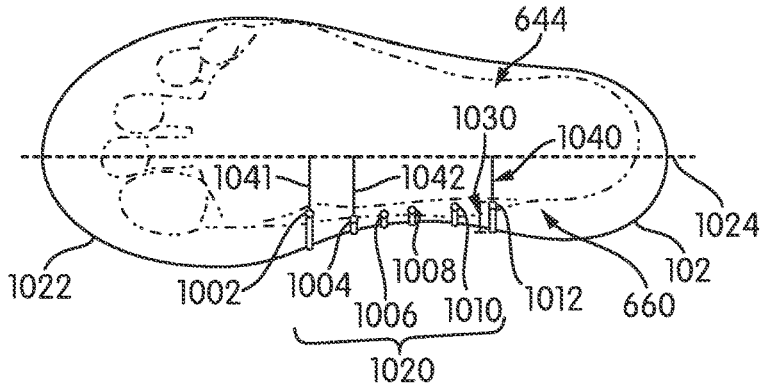
FIG. 25 shows a bottom view of a midsole schematic suitable for a collapsed arch.

In FIG. 25, the distance between first connection point 1002, second connection point 1004, third connection point 1006, fourth connection point 1008, fifth connection point 1010, and sixth connection point 1012, and peripheral edge 1022 decreases toward the midfoot. In FIG. 25, this is illustrated by seventh distance 1041 being greater than eighth distance 1042 as the distances of the set of distances 1040 from midline 1024 increases toward the midfoot. Such a pattern may better fit a foot with collapsed arch.

FIGS. 22-25 illustrate the spacing in the lateral direction as approximately constant for clarity because the focus is on lateral spacing between ends and periphery or midline, but in other embodiments the spacing between ends in this lengthwise direction could vary in any manner as necessary.

The connection point pattern may be configured to complement the placement of the reinforcing elements on the upper. In some embodiments, the combination of connection points with the upper locations fits the shape of the reinforcing elements to the foot of the wearer. In some of these embodiments, the reinforcing elements fit the medial side of the foot of the wearer. In still further embodiments, the reinforcing elements fit the foot at the medial midsole along the arch. In some embodiments the fit of the reinforcing elements to the foot provides tactile feedback. In other embodiments the fit of the reinforcing elements to the foot provides support to the foot. In other embodiments still, the fit of the reinforcing elements to the foot provides both tactile feedback and support to the wearer's foot.

By keeping the reinforcing elements tangential to the arch on the wearer's foot, the reinforcing elements stay in contact with the wearer's foot, but do not press against the wearer's foot during a normal stance. However, when the foot excessively rolls (i.e., overpronation) during the gait cycle, the foot rolls onto the arch and thus onto the reinforcing elements. The reinforcing elements thus give support to the foot during the overpronation, and provide tactile feedback. In embodiments where the reinforcing elements are tensile strands, the reinforcing elements can be easily felt due to their relatively small surface area when weight is distributed over to them. By choosing a connection point pattern matching the shape of the wearer's foot, and connecting the reinforcing elements to the upper such that the reinforcing elements conform to the arch, the tactile feedback and support given by the reinforcing elements provide proprioceptive awareness to users, so she or he can choose to adjust their behavior (e.g., control their pronation and avoid overpronation).

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper;

a sole structure coupled to the upper, wherein the sole structure and the upper define an interior cavity therebetween, the sole structure has a medial side and a lateral side opposite the medial side; and a reinforcing element spanning from the sole structure to the upper within the interior cavity;

wherein the reinforcing element has a first end and a second end;

wherein each of the first end and the second end of the reinforcing element is attached to the sole structure at the medial side; and wherein the article of footwear includes a fastening system disposed on the upper, the reinforcing element includes an intermediate portion disposed between the first end and the second end, and the intermediate portion is attached to the fastening system.

2. The article of footwear according to claim 1, wherein the reinforcing element extends through the upper.

3. The article of footwear according to claim 1, wherein the reinforcing element is flexible to conform to a wearer's arch.

4. The article of footwear according to claim 1, wherein the reinforcing element provides proprioceptive feedback, and each of the first end and the second end of the reinforcing element is directly fixed to the sole structure at the medial side inside the interior cavity to maintain each of the first end and the second end of the reinforcing element stationary relative to the sole structure.

5. The article of footwear according to claim 1, wherein tightening the reinforcing element tightens the reinforcing element between a medial side of the upper and the medial side of the sole structure.

6. The article of footwear according to claim 1, wherein the fastening system includes a plurality of eyelets and a lace extending through the plurality of eyelets, and the reinforcing element is attached to at least one eyelet of the plurality of eyelets.

7. An article of footwear, comprising:

an upper;

a sole structure coupled to the upper, wherein the sole structure defines a midline and a peripheral edge, the sole structure has a medial side and a lateral side opposite the medial side, the lateral side is spaced apart from the medial side along a lateral direction, and the sole structure and the upper define an interior cavity therebetween;

a first reinforcing element extending from the sole structure to the upper within the interior cavity, wherein at least one end of the first reinforcing element is attached to the sole structure;

a second reinforcing element extending from the sole structure to the upper within the interior cavity, wherein at least one end of the second reinforcing element is attached to the sole structure;

wherein each of the first reinforcing element and the second reinforcing element has a first end and a second end;

wherein each of the first end and the second end of the first reinforcing element is attached to the sole structure at the medial side;

wherein a distance from the peripheral edge of the sole structure to the first end of the first reinforcing element along the lateral direction differs from a distance from the peripheral edge of the sole structure to the first end of the second reinforcing element along the lateral direction; and wherein the article of footwear includes a fastening system disposed on the upper, the first reinforcing element includes an intermediate portion disposed between the first end and the second end, and the intermediate portion is attached to the fastening system.

8. The article of footwear according to claim 7, further comprising a third reinforcing element extending from the upper to the sole structure, wherein at least one end of the third reinforcing element is attached to the sole structure.

9. The article of footwear according to claim 8, wherein:

the distance from the peripheral edge of the sole structure to the first end of the first reinforcing element differs from a distance from the peripheral edge of the sole structure to the at least one end of the third reinforcing element; and the distance from the peripheral edge of the sole structure to the first end of the second reinforcing element differs from the distance from the peripheral edge to the at least one end of the third reinforcing element.

10. The article of footwear according to claim 8, wherein a distance from the midline of the sole structure to the at least one end of the first reinforcing element differs from a distance from the midline of the sole structure to the at least one end of the second reinforcing element and a distance from the midline of the sole structure to the at least one end of the third reinforcing element.

11. The article of footwear according to claim 8, wherein a distance from the first end of the first reinforcing element along the lateral direction to the first end of the second reinforcing element differs from a distance from the first end of the second reinforcing element along the lateral direction to the first end of the third reinforcing element.

12. The article of footwear according to claim 7, wherein the first reinforcing element and the second reinforcing element are tensile strands, and each of the first end and the second end of each of the first reinforcing element and the second reinforcing element is directly fixed to the sole structure to maintain each of the first end and the second end of each of the first reinforcing element and the second reinforcing element stationary relative to the sole structure.

13. The article of footwear according to claim 7, wherein a distance from the midline of the sole structure to the first end of the first reinforcing element differs from a distance from the midline of the sole structure to the first end of the second reinforcing element.

14. An article of footwear, comprising:

an upper including a fastening system;

a sole structure coupled to the upper, wherein the sole structure defines a peripheral edge, the sole structure has a medial side and a lateral side opposite the medial side, and the sole structure and the upper collectively define an interior cavity therebetween;

a plurality of reinforcing elements extending from the sole structure to the upper; wherein the plurality of reinforcing elements connects to the sole structure inward from the peripheral edge of the sole structure;

wherein the plurality of reinforcing elements are configured to conform to an arch of a foot inserted within the interior cavity; and wherein the plurality of reinforcing elements provide proprioceptive feedback;

wherein the article of footwear includes a forefoot region, a heel region, and a midfoot region disposed between the forefoot region and the heel region;

wherein each of the plurality of reinforcing elements has a first end and a second end;

wherein each of the first end and the second end of each of the plurality of reinforcing elements is fixed to the sole structure at the medial side to maintain each of the first end and the second end of each of the plurality of reinforcing elements stationary relative to the sole structure; and wherein each of the first end and the second end of each of the plurality of reinforcing elements is fixed to the sole structure at the midfoot region.

15. The article of footwear according to claim 14, wherein the plurality of reinforcing elements are tensile strands, and each of the first end and the second end of each of the plurality of reinforcing elements is directly fixed to the sole structure at the medial side inside the interior cavity.

16. The article of footwear according to claim 14, wherein tightening the fastening system tightens the plurality of reinforcing elements.

17. The article of footwear according to claim 14, wherein the fastening system includes a plurality of eyelets and a lace extending through the plurality of eyelets, and at least one reinforcing element of the plurality of reinforcing elements is attached to at least one eyelet of the plurality of eyelets.

* * * * *